US010964256B2

(12) United States Patent
Xuan et al.

(10) Patent No.: US 10,964,256 B2
(45) Date of Patent: Mar. 30, 2021

(54) METHOD FOR DRIVING A PIXEL CIRCUIT

(71) Applicant: BOE TECHNOLOGY GROUP CO., LTD., Beijing (CN)

(72) Inventors: Minghua Xuan, Beijing (CN); Shengji Yang, Beijing (CN); Lei Wang, Beijing (CN); Li Xiao, Beijing (CN); Jie Fu, Beijing (CN); Pengcheng Lu, Beijing (CN); Dongni Liu, Beijing (CN); Xiaochuan Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/329,419

(22) PCT Filed: May 15, 2018

(86) PCT No.: PCT/CN2018/086779
§ 371 (c)(1),
(2) Date: Feb. 28, 2019

(87) PCT Pub. No.: WO2018/210211
PCT Pub. Date: Nov. 22, 2018

(65) Prior Publication Data

US 2019/0197948 A1 Jun. 27, 2019

(30) Foreign Application Priority Data

May 19, 2017 (CN) ..... 201710358196.5

(51) Int. Cl.
*G09G 3/30* (2006.01)
*G09G 3/36* (2006.01)
(Continued)

(52) U.S. Cl.
CPC ..... *G09G 3/3225* (2013.01); *G09G 3/3258* (2013.01); *G09G 3/3275* (2013.01);
(Continued)

(58) Field of Classification Search
CPC .... G09G 2310/0285–96; G09G 3/3611–3696; G09G 2300/0439–0478; G09G 2320/0209–0295
See application file for complete search history.

(56) References Cited

U.S. PATENT DOCUMENTS

2002/0024054 A1* 2/2002 Koyama ..... G09G 3/3275 257/84
2002/0036626 A1 3/2002 Tsutsui
(Continued)

FOREIGN PATENT DOCUMENTS

CN 1345024 A 4/2002
CN 1497511 A 5/2004
(Continued)

OTHER PUBLICATIONS

International Search Report and Written Opinion of the International Searching Authority (with English language translation of Written Opinion), International Application No. PCT/CN2018/086779, dated Jul. 31, 2018, 13 pp.
(Continued)

*Primary Examiner* — Sanghyuk Park
(74) *Attorney, Agent, or Firm* — Myers Bigel, P.A.

(57) ABSTRACT

A pixel circuit, a driving method thereof, and a display device are provided. A driving sub-circuit of the pixel circuit is configured to provide a data signal from the data signal terminal to the driving node under the control of a driving signal from the driving signal terminal. A holding sub-circuit of the pixel circuit is configured to acquire a potential of the driving node under the control of a first switching signal from the first switching signal terminal, and maintain the potential of the driving node unchanged under the control of a first power signal from the first power signal terminal and a second power signal from the second power signal terminal. A light emitting sub-circuit of the pixel circuit is
(Continued)

connected to the driving node and is configured to emit light under the driving of the driving node.

4 Claims, 8 Drawing Sheets

(51) Int. Cl.
*G09G 3/3225* (2016.01)
*G09G 3/3258* (2016.01)
*G09G 3/3275* (2016.01)

(52) U.S. Cl.
CPC ..... *G09G 2300/0842* (2013.01); *G09G 2300/0857* (2013.01); *G09G 2330/021* (2013.01)

(56) References Cited

U.S. PATENT DOCUMENTS

2002/0036628 A1* 3/2002 Uehara ..... G09G 3/3648 345/204
2002/0075205 A1* 6/2002 Kimura ..... G09G 3/3659 345/55
2002/0089471 A1* 7/2002 Murata ..... G09G 3/3614 345/55
2004/0066358 A1 4/2004 Numao
2005/0122289 A1* 6/2005 Yamazaki ..... G09G 3/3241 345/77
2008/0238867 A1 10/2008 Maeda et al.
2010/0001946 A1 1/2010 Murayama et al.
2011/0134157 A1 6/2011 Chaji
2018/0114497 A1* 4/2018 Tan ..... G09G 3/3651
2019/0197948 A1 6/2019 Xuan et al.

FOREIGN PATENT DOCUMENTS

CN 101276120 A 10/2008
CN 101620354 A 1/2010
CN 101980544 A 2/2011
CN 102402936 A 4/2012
CN 103258498 A 8/2013
CN 105489167 A 4/2016
CN 105637575 A 6/2016
CN 206021875 U 3/2017
CN 106935202 A 7/2017
JP 8-194205 A 7/1996

OTHER PUBLICATIONS

Office Action with English language translation, CN Application No. 201710358196.5, dated Oct. 9, 2018, 7 pp.

* cited by examiner

METHOD FOR DRIVING A PIXEL CIRCUIT

CROSS REFERENCE TO RELATED APPLICATIONS

The present application is a 35 U.S.C. 371 national stage application of PCT International Application No. PCT/CN2018/086779, filed on May 15, 2018, which claims the benefit of Chinese Patent Application No. 201710358196.5, filed on May 19, 2017, the contents of which are incorporated herein by reference in their entireties. The above-referenced PCT International Application was published in the Chinese language as International Publication No. WO 2018/210211 A1 on Nov. 22, 2018.

FIELD

The present disclosure relates to the field of display technologies, and particularly to a pixel circuit, a driving method thereof, and a display device.

BACKGROUND

With the development of display technology, organic light emitting diode (OLED), as a current-type light emitting device, is more and more applied in the field of high performance display owing to its characteristics such as self-illumination, fast response, wide viewing angle, and the like.

An OLED pixel circuit structure is a circuit structure that controls a current flowing through the OLED by a driving transistor, which is mainly applied to a display device. The OLED pixel circuit structure generally comprises a plurality of transistors and one OLED, and the plurality of transistors are capable of converting a data voltage of a data signal terminal into a driving current for driving the OLED, thereby driving the OLED to emit light.

However, in case an OLED display device displays an all-white image or displays a same image for a long time, the data signal terminal needs to continuously input a pulse signal of a same data voltage so that image display can be maintained, which results in a high power consumption of the display device during the display process.

SUMMARY

An aspect of the present disclosure provides a pixel circuit comprising a driving sub-circuit, a holding sub-circuit, and a light emitting sub-circuit. The driving sub-circuit is connected to a driving signal terminal, a data signal terminal and a driving node, respectively, and configured to provide the driving node with a data signal from the data signal terminal under the control of a driving signal from the driving signal terminal. The holding sub-circuit is connected to the driving node, a first switching signal terminal, a first power signal terminal and a second power signal terminal, respectively, and configured to acquire a potential of the driving node under the control of a first switching signal from the first switching signal terminal, and maintain the potential of the driving node unchanged under the control of a first power signal from the first power signal terminal and a second power signal from the second power signal terminal. The light emitting sub-circuit is connected to the driving node and configured to emit light under the driving of the driving node.

According to some embodiments of the present disclosure, the holding sub-circuit comprises a switching circuit unit and a holding circuit unit. The switching circuit unit is connected to the driving node, the first switching signal terminal and a first storage node, respectively, and configured to control the driving node to be connected to and disconnected from the first storage node under the control of the first switching signal. The holding circuit unit is connected to the first storage node, the first power signal terminal and the second power signal terminal, respectively, and configured to maintain a potential of the first storage node unchanged under the control of the first power signal and the second power signal.

According to some embodiments of the present disclosure, the switching circuit unit comprises a first transistor. A control terminal of the first transistor is connected to the first switching signal terminal, a first terminal of the first transistor is connected to the first storage node, and a second terminal of the first transistor is connected to the driving node.

According to some embodiments of the present disclosure, the holding circuit unit comprises a second transistor, a third transistor, a fourth transistor, and a fifth transistor. A control terminal of the second transistor is connected to a second storage node, a first terminal of the second transistor is connected to the first power signal terminal, and a second terminal of the second transistor is connected to the first storage node. A control terminal of the third transistor is connected to the second storage node, a first terminal of the third transistor is connected to the second power signal terminal, and a second terminal of the third transistor is connected to the first storage node. A control terminal of the fourth transistor is connected to the first storage node, a first terminal of the fourth transistor is connected to the first power signal terminal, and a second terminal of the fourth transistor is connected to the second storage node. A control terminal of the fifth transistor is connected to the first storage node, a first terminal of the fifth transistor is connected to the second power signal terminal, and a second terminal of the fifth transistor is connected to the second storage node. The second transistor and the fourth transistor are of a same type, the third transistor and the fifth transistor are of a same type, and the second transistor and the third transistor are of opposite types.

According to some embodiments of the present disclosure, the switching circuit unit further comprises a sixth transistor. A control terminal of the sixth transistor is connected to a second switching signal terminal, a first terminal of the sixth transistor is connected to the second storage node, and a second terminal of the sixth transistor is connected to the driving node.

According to some embodiments of the present disclosure, the driving sub-circuit comprises a seventh transistor. A control terminal of the seventh transistor is connected to the driving signal terminal, a first terminal of the seventh transistor is connected to the data signal terminal, and a second terminal of the seventh transistor is connected to the driving node.

According to some embodiments of the present disclosure, the light emitting sub-circuit comprises an organic light emitting diode. One end of the organic light emitting diode is connected to the driving node, and the other end of the organic light emitting diode is connected to a preset power signal terminal.

According to some embodiments of the present disclosure, the preset power signal terminal is one of the second power signal terminal and a ground terminal.

According to some embodiments of the present disclosure, the first transistor, the third transistor, the fifth transistor and the seventh transistor are all N-type transistors, and the second transistor and the fourth transistor are both P-type transistors.

Another aspect of the present disclosure provides a method for driving the pixel circuit described above. The method comprises: in a data writing phase, the driving signal and the first switching signal being both at a first potential, the driving sub-circuit providing the data signal to the driving node, and the holding sub-circuit acquiring the potential of the driving node; and in an image holding phase, the driving signal being at a second potential, the first switching signal maintaining a first potential, the data signal terminal not providing a data signal, the first power signal being at a first potential, the second power signal being at a second potential, and the holding sub-circuit maintaining the potential of the driving node unchanged.

According to some embodiments of the present disclosure, the holding sub-circuit comprises a switching circuit unit and a holding circuit unit, the switching circuit unit comprising a first transistor, the holding circuit unit comprising a second transistor, a third transistor, a fourth transistor and a fifth transistor, and the driving sub-circuit comprising a seventh transistor. In the data writing phase, the driving signal and the first switching signal are both at a first potential, the first transistor and the seventh transistor are turned on, the data signal terminal provides the data signal to the driving node, the driving node is in communication with a first storage node, and the potential of the driving node is written to the first storage node. In the image holding phase, the driving signal is at a second potential, the first switching signal maintains at a first potential, the seventh transistor is turned off, the first transistor is turned on, in response to the potential written to the first storage node being a first potential in the data writing phase, the fifth transistor is turned on, the second power signal terminal writes the second power signal to the second storage node, the second transistor is turned on, and the first power signal terminal writes the first power signal to the first storage node; in response to the potential written to the first storage node being a second potential in the data writing phase, the fourth transistor is turned on, the first power signal terminal writes the first power signal to the second storage node, the third transistor is turned on, and the second power signal terminal writes the second power signal to the first storage node.

According to some embodiments of the present disclosure, the switching circuit unit further comprises a sixth transistor, a control terminal of the sixth transistor being connected to a second switching signal terminal, a first terminal of the sixth transistor being connected to the second storage node, and a second terminal of the sixth transistor being connected to the driving node. After the data writing phase, the method further comprises: in a reverse display phase, the driving signal and the first switching signal are both at a second potential, a second switching signal outputted by the second switching signal terminal is at a first potential, the seventh transistor is turned off, the sixth transistor is turned on, the potential of the second storage node is written to the driving node, and the light emitting sub-circuit emits light under the driving of the driving node.

According to some embodiments of the present disclosure, the first transistor, the third transistor, the fifth transistor and the seventh transistor are all N-type transistors, and the second transistor and the fourth transistor are both P-type transistors. The first potential is at a higher potential relative to the second potential.

A further aspect of the present disclosure provides a display device comprising any of the pixel circuits described above.

BRIEF DESCRIPTION OF THE DRAWINGS

In order to illustrate the technical solutions in embodiments of the present disclosure more clearly, the drawings that need to be used for description of the embodiments will be briefly described below. It is apparent that the drawings in the description below are only some of the embodiments of the present disclosure, and other drawings may be further obtained by those ordinarily skilled in the art based on those drawings without spending inventive efforts.

DETAILED DESCRIPTION

To make the objective, technical solutions and advantages of the present disclosure clearer, embodiments of the present disclosure will be further described in detail below with reference to the accompanying drawings.

Before specific embodiments of the present disclosure are described in detail, it is to be noted that transistors employed in all the embodiments of the present disclosure may be thin film transistors or field effect transistors or other devices having the same characteristics. The transistors employed in embodiments of the present disclosure are primarily switching transistors in terms of their roles in the circuit. Since a source and a drain of a switching transistor used here are symmetrical, the source and the drain thereof are interchangeable. In embodiments of the present disclosure, one of the source and the drain is referred to as a first terminal, the other of the source and the drain is referred to as a second terminal, and a gate is referred to as a control terminal. In addition, the switching transistor employed in embodiments of the present disclosure may adopt either of a P-type switching transistor and an N-type switching transistor, wherein the P-type switching transistor is turned on when its control terminal is at a low level, and turned off when its control terminal is at a high level; the N-type switching transistor is turned on when its control terminal is at a high level, and turned off when its control terminal is at a low level. In addition, each of multiple signals in various embodiments of the present disclosure corresponds to a first potential and a second potential, respectively. The first potential and the second potential only represent that the potential of said signal has two state quantities. It does not mean that the first potential or the second potential has a specific value throughout the description.

Figure 1:
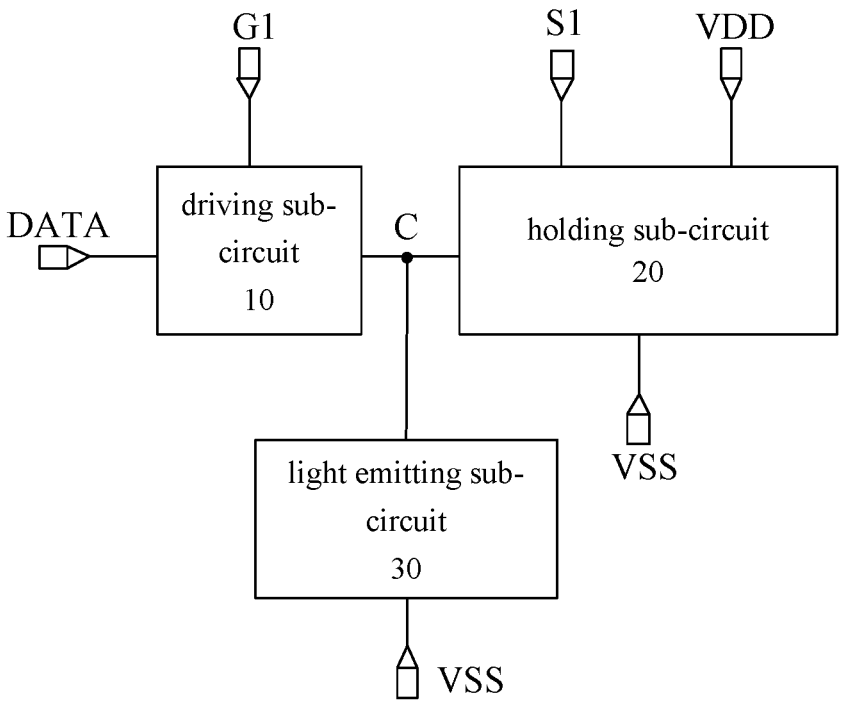
FIG. 1 is a schematic structural view of a pixel circuit provided by an embodiment of the present disclosure.

FIG. 1 is a schematic structural view of a pixel circuit provided by an embodiment of the present disclosure. As shown in FIG. 1, the pixel circuit comprises a driving sub-circuit 10, a holding sub-circuit 20, and a light emitting sub-circuit 30.

The driving sub-circuit 10 is connected to a driving signal terminal G1, a data signal terminal DATA and a driving node C, respectively, and is configured to output a data signal from the data signal terminal DATA to the driving node C under the control of a driving signal from the driving signal terminal G1.

The holding sub-circuit 20 is connected to the driving node C, a first switching signal terminal S1, a first power signal terminal VDD and a second power signal terminal VSS, respectively, and is configured to acquire a potential of the driving node C under the control of a first switching signal from the first switching signal terminal S1, and maintain the potential of the driving node C unchanged under the control of a first power signal from the first power signal terminal VDD and a second power signal from the second power signal terminal VSS.

The light emitting sub-circuit 30 is connected to the driving node C and the second power signal terminal VSS, and is configured to emit light under the driving of the potential of the driving node C.

The pixel circuit provided by an embodiment of the present disclosure comprises a holding sub-circuit which can acquire a potential of the driving node during the process of the driving sub-circuit driving the light emitting sub-circuit to emit light and control the potential of the driving node to remain unchanged. Therefore, in case a display device using the pixel circuit displays a same image for a long time, the potential of the driving node can be maintained by the holding sub-circuit, so that the data signal terminal does not need to continuously input the same data signal, thereby effectively reducing the power consumption of the display device.

Figure 2:
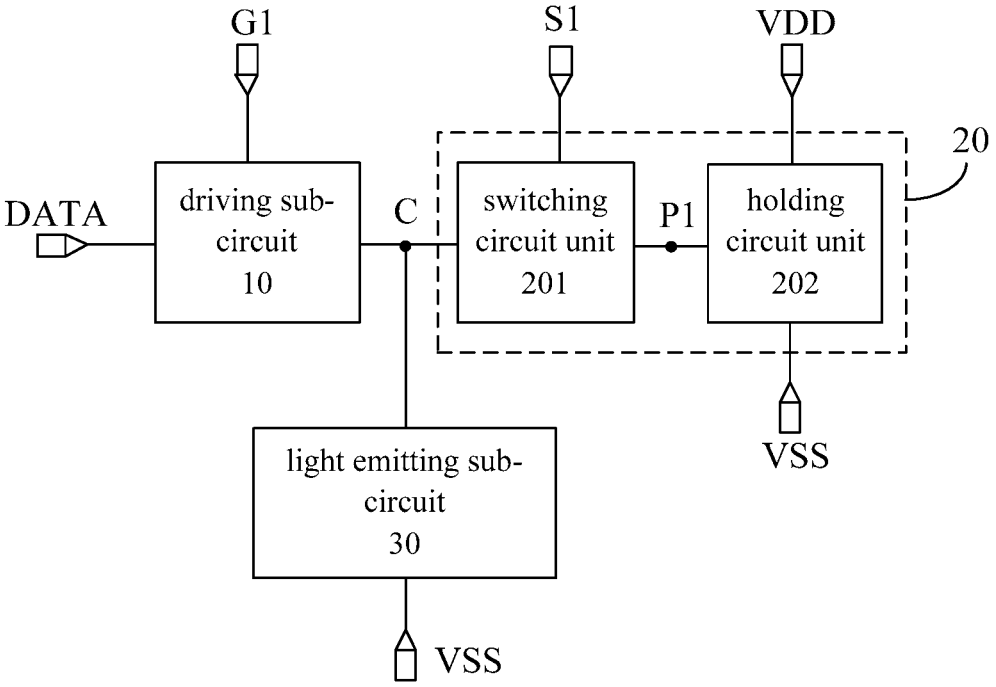
FIG. 2 is a schematic structural view of another pixel circuit provided by an embodiment of the present disclosure.

FIG. 2 is a schematic structural view of another pixel circuit provided by an embodiment of the present disclosure. As shown in FIG. 2, the holding sub-circuit 20 comprises a switching circuit unit 201 and a holding circuit unit 202.

The switching circuit unit 201 is connected to the driving node C, the first switching signal terminal S1 and a first storage node P1, respectively, and is configured to control the driving node C to be connected to and disconnected from the first storage node P1 under the control of the first switching signal.

The holding circuit unit 202 is connected to the first storage node P1, the first power signal terminal VDD and the second power signal terminal VSS, respectively, and is configured to maintain a potential of the first storage node P1 unchanged under the control of the first power signal and the second power signal.

Figure 3:
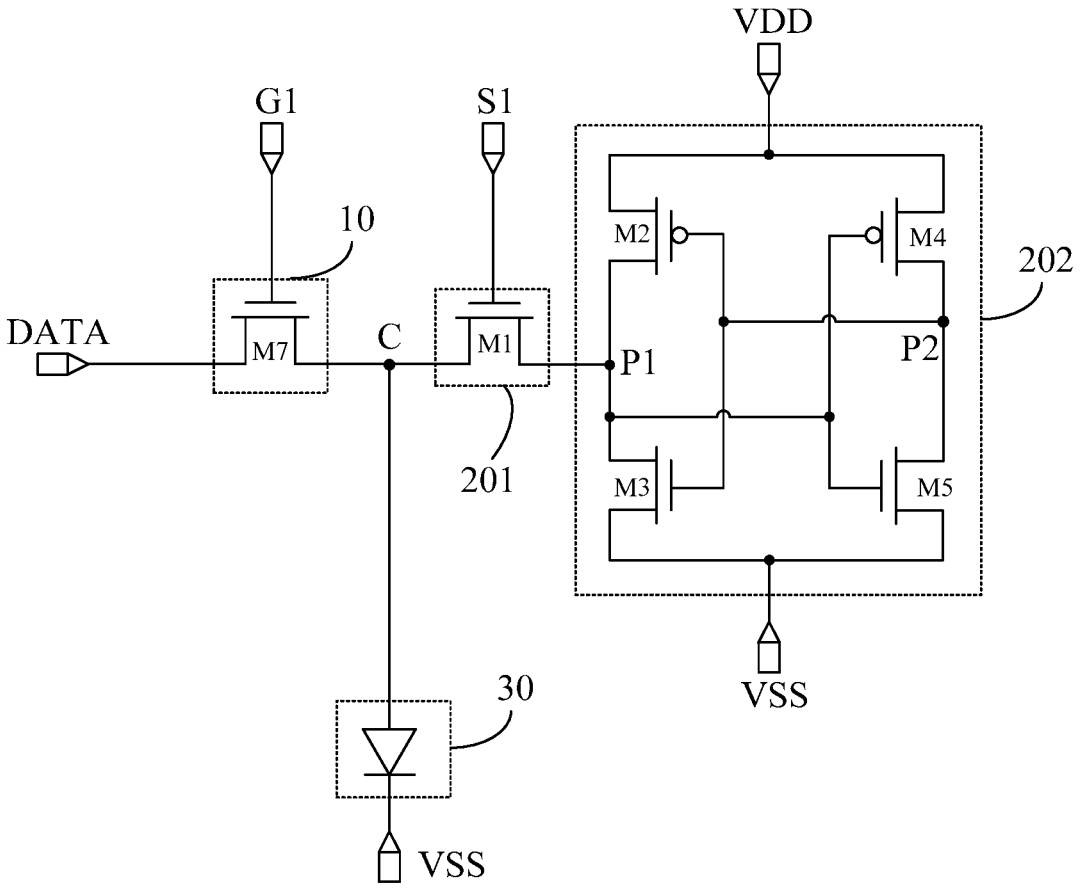
FIG. 3 is a schematic structural view of a further pixel circuit provided by an embodiment of the present disclosure.

FIG. 3 is a schematic structural view of a further pixel circuit provided by an embodiment of the present disclosure. As shown in FIG. 3, the switching circuit unit 201 comprises a first transistor M1. The holding circuit unit 202 comprises a second transistor M2, a third transistor M3, a fourth transistor M4, and a fifth transistor M5.

A control terminal of the first transistor M1 is connected to the first switching signal terminal S1, a first terminal of the first transistor M1 is connected to the first storage node P1, and a second terminal of the first transistor M1 is connected to the driving node C.

A control terminal of the second transistor M2 is connected to a second storage node P2, a first terminal of the second transistor M2 is connected to the first power signal terminal VDD, and a second terminal of the second transistor M2 is connected to the first storage node P1.

A control terminal of the third transistor M3 is connected to the second storage node P2, a first terminal of the third transistor M3 is connected to the second power signal terminal VSS, and a second terminal of the third transistor M3 is connected to the first storage node P1.

A control terminal of the fourth transistor M4 is connected to the first storage node P1, a first terminal of the fourth transistor M4 is connected to the first power signal terminal VDD, and a second terminal of the fourth transistor M4 is connected to the second storage node P2.

A control terminal of the fifth transistor M5 is connected to the first storage node P1, a first terminal of the fifth transistor M5 is connected to the second power signal terminal VSS, and a second terminal of the fifth transistor M5 is connected to the second storage node P2.

The second transistor M2 and the fourth transistor M4 are of the same type (i.e. N-type or P-type), the third transistor M3 and the fifth transistor M5 are of the same type, and the second transistor M2 and the third transistor M3 are of opposite types. For example, as shown in FIG. 3, the second transistor M2 and the fourth transistor M4 may be P-type transistors, and the third transistor M3 and the fifth transistor M5 may be N-type transistors, or vice versa.

Figure 4:
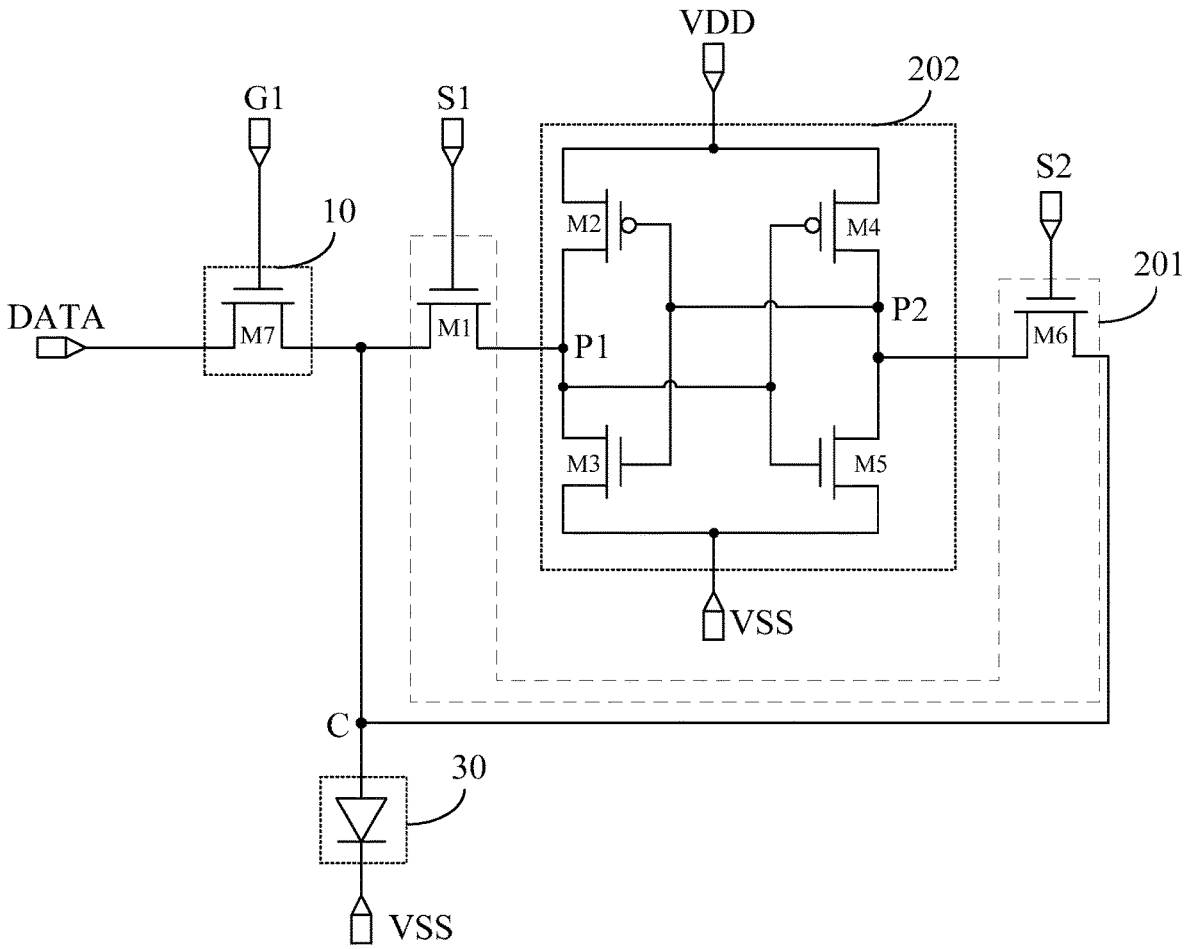
FIG. 4 is a schematic structural view of yet another pixel circuit is provided by an embodiment of the present disclosure.

FIG. 4 is a schematic structural view of yet another pixel circuit provided by an embodiment of the present disclosure. As shown in FIG. 4, the switching circuit unit 201 further comprises a sixth transistor M6.

A control terminal of the sixth transistor M6 is connected to the second switching signal terminal S2, a first terminal of the sixth transistor M6 is connected to the second storage node P2, and a second terminal of the sixth transistor M6 is connected to the driving node C.

Referring to FIGS. 3 and 4, in the pixel circuit provided by an exemplary embodiment of the present disclosure, the driving sub-circuit 10 comprises a seventh transistor M7, and the light emitting sub-circuit 30 comprises an organic light emitting diode.

A control terminal of the seventh transistor M7 is connected to the driving signal terminal G1, a first terminal of the seventh transistor M7 is connected to the data signal terminal DATA, and a second terminal of the seventh transistor M7 is connected to the driving node C.

One end of the organic light emitting diode is connected to the driving node C, and the other end of the organic light emitting diode is connected to a preset power signal terminal. For example, the other end of the organic light emitting diode may be grounded or, as shown in FIGS. 3 and 4, may be connected to the second power signal terminal VSS.

The pixel circuit provided by embodiments of the present disclosure comprises a holding sub-circuit which can acquire the potential of the driving node during the process of the driving sub-circuit driving the light emitting sub-circuit to emit light and control the potential of the driving node to remain unchanged. Therefore, in case a display device using the pixel circuit displays a same image for a long time, the potential of the driving node can be maintained by the holding sub-circuit, so that the data signal terminal does not need to continuously input the same data signal, thereby effectively reducing the power consumption of the display device.

Figure 5:
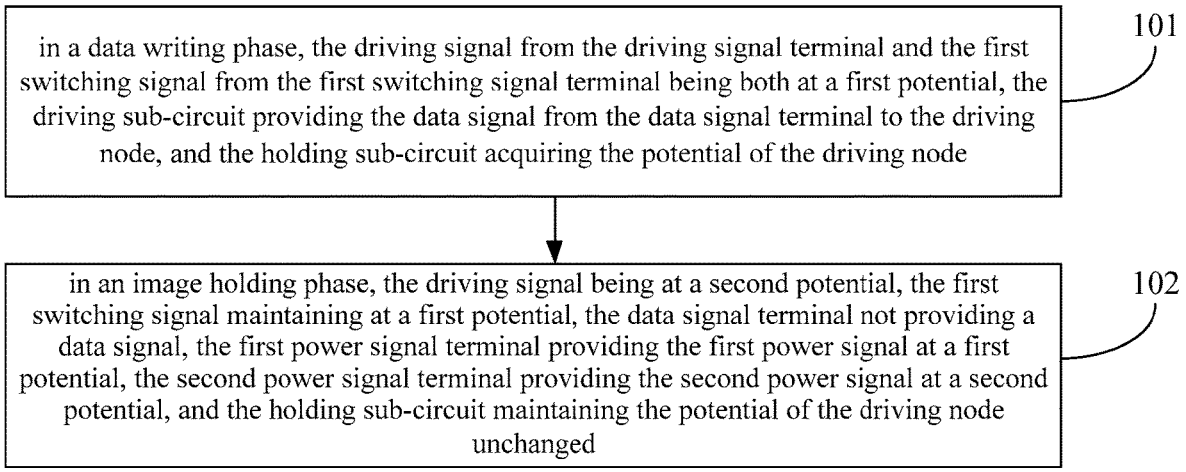
FIG. 5 is a flow chart of a method for driving a pixel circuit provided by an embodiment of the present disclosure.

FIG. 5 is a flow chart of a method for driving a pixel circuit provided by an embodiment of the present disclosure, which may be used to drive the pixel circuit as shown in any of FIGS. 1 to 4.

As shown in FIG. 5, in a data writing phase 101, the driving signal from the driving signal terminal G1 and the first switching signal from the first switching signal terminal S1 are both at a first potential, the driving sub-circuit 10 outputs the data signal from the data signal terminal DATA to the driving node C, and the holding sub-circuit 20 acquires the potential of the driving node C.

In an image holding phase 102, the driving signal is at a second potential, the first switching signal maintains a first potential, the data signal terminal does not provide a data signal, the first power signal terminal VDD provides a first power signal at a first potential, the second power signal terminal VSS provides a second power signal at a second potential, and the holding sub-circuit 20 maintains the potential of the driving node C unchanged.

Figure 6:
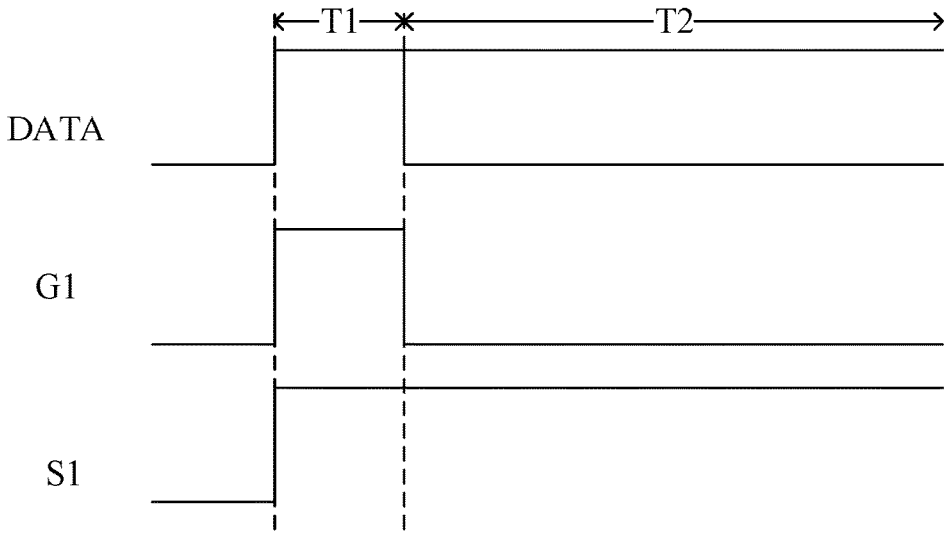
FIG. 6 is a timing diagram of a driving process for a pixel circuit provided by an embodiment of the present disclosure.

Referring to FIG. 3, the holding sub-circuit 20 comprises a switching circuit unit 201 and a holding circuit unit 202. The switching circuit unit 201 comprises a first transistor M1. The holding circuit unit 202 comprises a second transistor M2, a third transistor M3, a fourth transistor M4, and a fifth transistor M5. The drive sub-circuit 10 comprises a seventh transistor M7. FIG. 6 is a timing diagram of a driving process for a pixel circuit provided by an embodiment of the present disclosure, wherein the driving principle for the pixel circuit provided by an embodiment of the present disclosure is described in detail by taking the pixel circuit shown in FIG. 3 as an example.

Referring to FIG. 6, in a data writing phase T1, the driving signal from the driving signal terminal G1 and the first switching signal from the first switching signal terminal S1 are both at a first potential, so that the first transistor M1 and the seventh transistor M7 are turned on, the data signal terminal DATA writes the data signal to the driving node C through the seventh transistor M7, and the organic light emitting diode emits light under the driving of the potential of the driving node C. Since the driving node C is in communication with the first storage node P1 through the first transistor M1, the potential of the driving node C, i.e. the potential of the data signal, may be written to the first storage node P1.

Figure 7:
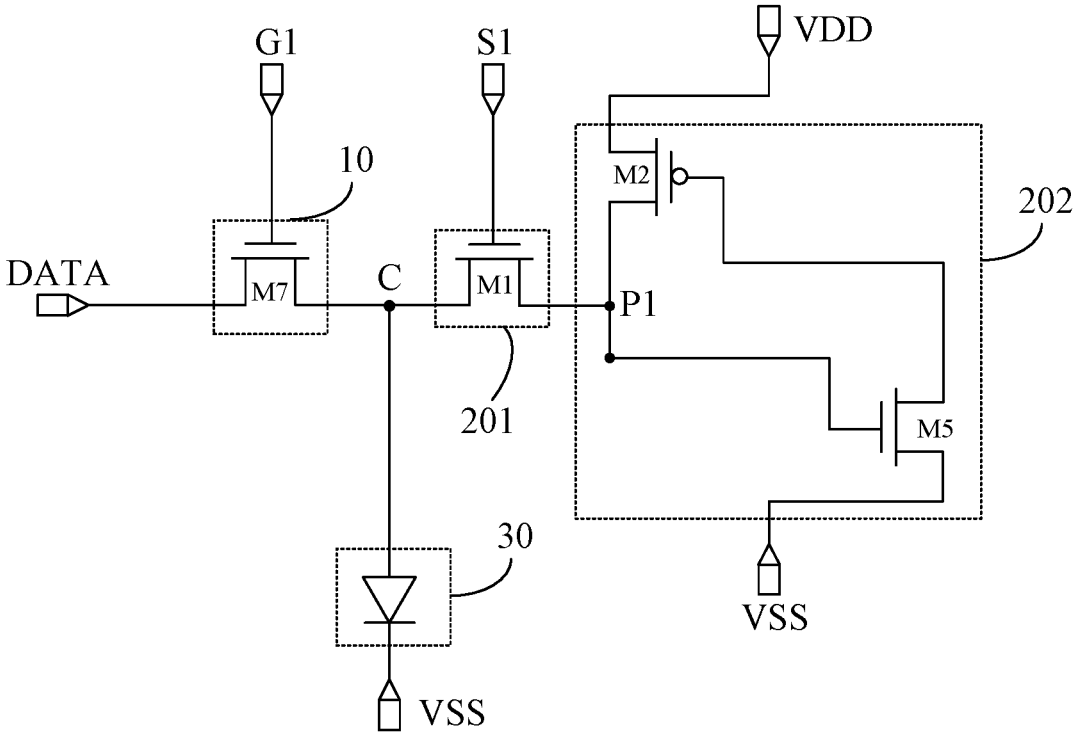
FIG. 7 is an equivalent circuit diagram of a pixel circuit provided by an embodiment of the present disclosure in a data writing phase.

When the potential of the data signal is a first potential, an equivalent circuit diagram of the pixel circuit in the data writing phase T1 may be as shown in FIG. 7. Referring to FIG. 7, the fifth transistor M5 is turned on under the driving of the potential of the first storage node P1 (i.e. the first potential), and outputs the second power signal from the second power signal terminal VSS to the control terminal of the second transistor M2, so that the second transistor M2 is turned on. The third transistor M3 and the fourth transistor M4 are turned off, so that the first power signal terminal VDD can provide the first storage node P1 with the first power signal at the first potential.

Figure 8:
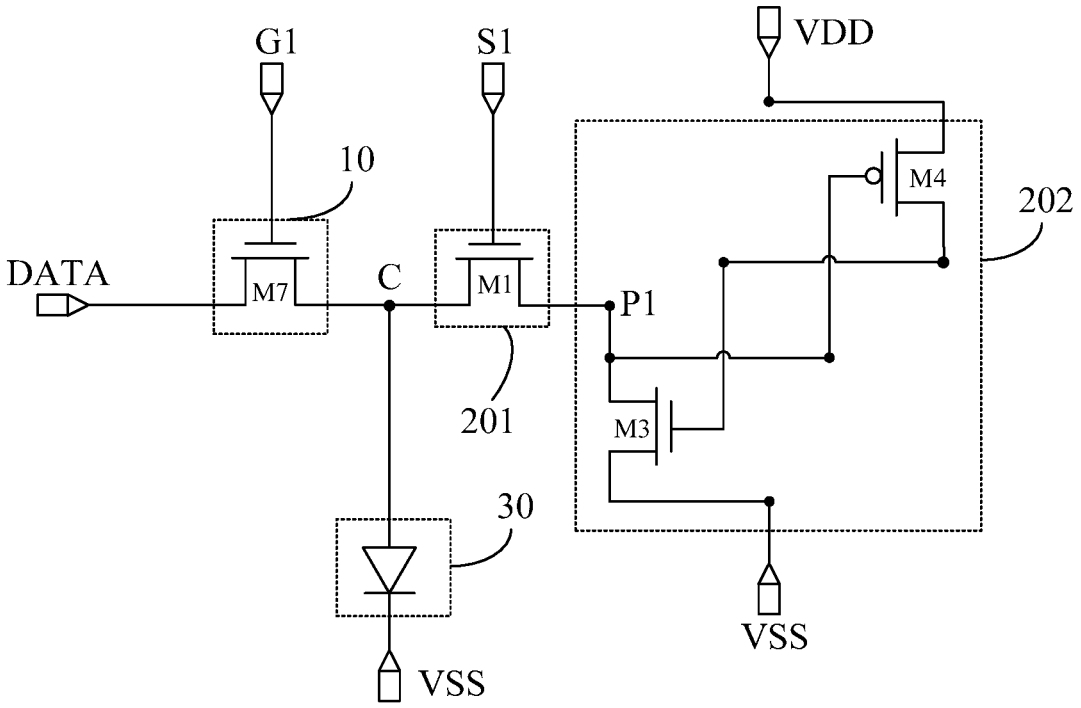
FIG. 8 is an equivalent circuit diagram of another pixel circuit provided by an embodiment of the present disclosure in a data writing phase.

When the potential of the data signal is a second potential, an equivalent circuit diagram of the pixel circuit in the data writing phase T1 may be as shown in FIG. 8. Referring to FIG. 8, the fourth transistor M4 is turned on under the driving of the potential of the first storage node P1 (i.e. the second potential), and outputs the first power signal from the first power signal terminal VDD to the control terminal of the third transistor M3, so that the third transistor M3 is turned on. The second transistor M2 and the fifth transistor M5 are turned off, so that the second power signal terminal VSS can provide the first storage node P1 with the second power signal at the second potential.

Figure 9:
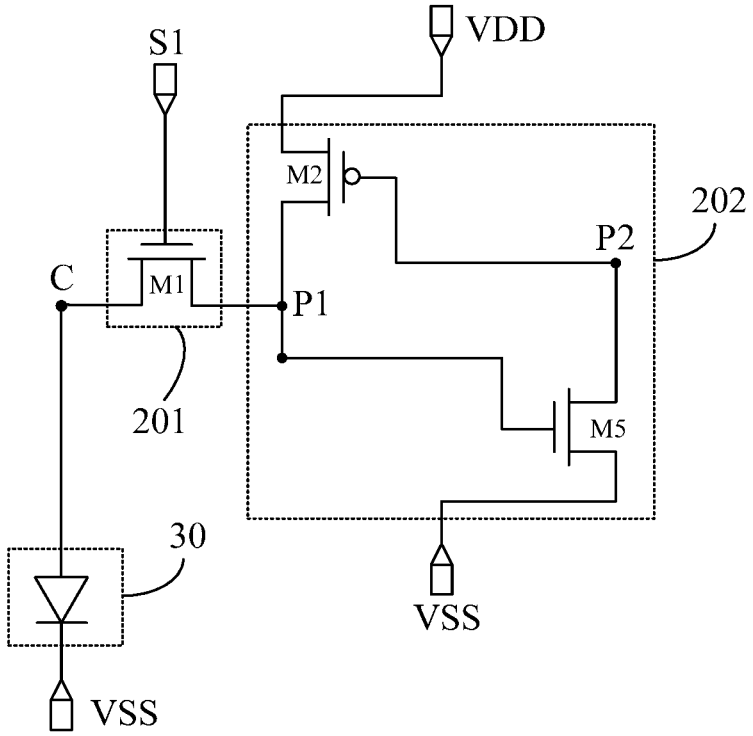
FIG. 9 is an equivalent circuit diagram of a pixel circuit provided by an embodiment of the present disclosure in an image holding phase.

In an image holding phase T2, as shown in FIG. 6, the data signal terminal DATA does not provide a data signal, the driving signal is at a second potential, the first switching signal maintains a first potential so that the seventh transistor M7 is turned off, and the first transistor M1 remains turned on. FIG. 9 is an equivalent circuit diagram of the pixel circuit shown in FIG. 3 in the image holding phase. If the potential written to the first storage node P1 in the data writing phase T1 is a first potential, referring to FIG. 9, the fifth transistor M5 may remain turned on in the image holding phase T2, and the second power signal terminal VSS continuously provides the second storage node P2 (i.e. the control terminal of the second transistor M2) with the second power signal to keep the second transistor M2 turned on, so that the first power signal terminal VDD may continuously provide the first storage node P1 with the first power signal at the first potential. The first storage node P1 is in communication with the driving node C through the first transistor M1, so that the driving node C continues to maintain the first potential written in the data writing phase T1 in case no data signal is inputted to the driving node C.

Figure 10:
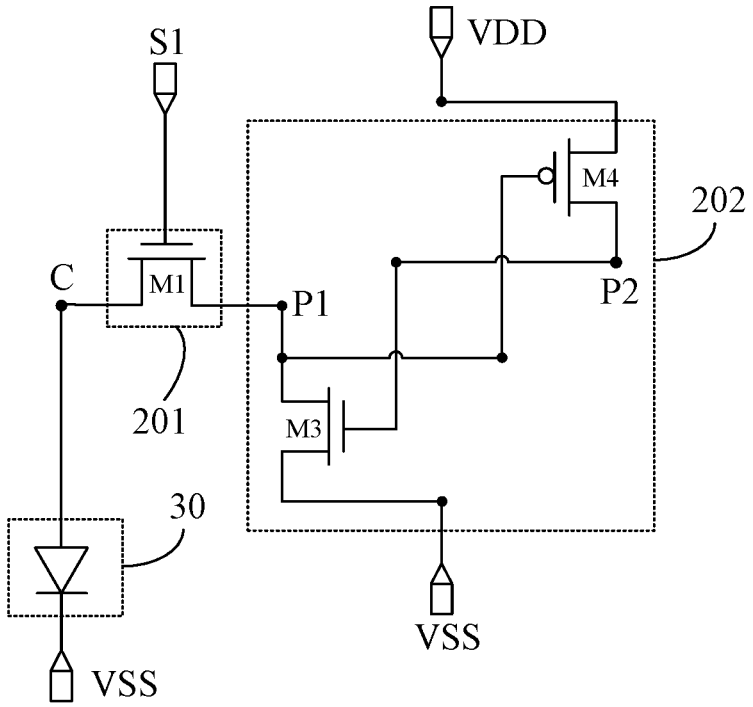
FIG. 10 is an equivalent circuit diagram of another pixel circuit provided by an embodiment of the present disclosure in an image holding phase.

FIG. 10 is another equivalent circuit diagram of the pixel circuit shown in FIG. 3 in the image holding phase, in which the potential written to the first storage node P1 in the data writing phase T1 is a second potential. The fourth transistor M4 remains turned on in the image holding phase T2, so that the first power signal terminal VDD can continuously provide the second storage node P2 (i.e. the control terminal of the third transistor M3) with the first power signal at the first potential to keep the third transistor M3 turned on. The second power signal terminal VSS can continuously provide the first storage node P1 with the second power signal at the second potential. The first storage node P1 is in communication with the driving node C through the first transistor M1, so that the driving node C continues to maintain the second potential written in the data writing phase T1 in case no data signal is inputted to the driving node C.

It can be obtained from the above analysis that, in the method for driving a pixel circuit as provided by an embodiment of the present disclosure, the potential of the driving node C in the image holding phase can remain unchanged relative to the data writing phase without the need for the data signal terminal DATA to provide a data signal, so that the image displayed by the display device remains the same, thereby effectively reducing the power consumption of the display device.

It is to be noted that, in embodiments of the present disclosure, the pixel circuit may further comprise a control sub-circuit. The control sub-circuit is configured to detect a magnitude of the potential of the data signal provided by the data signal terminal DATA in the data writing phase T1, and adjust a magnitude of the potential of the power signal provided by the first power signal terminal VDD or the second power signal terminal VDD according to the detected magnitude. For example, when the control sub-circuit detects that the potential provided from the data signal terminal to the driving node C is a high potential (greater than a certain threshold) in the data writing phase T1, the potential of the first power signal provided by the first power signal terminal VDD may be adjusted to be identical with the potential of the data signal. When the control sub-circuit detects that the potential provided from the data signal terminal to the driving node C is a low potential (less than a certain threshold) in the data writing phase T1, the potential of the second power signal provided by the second power signal terminal VSS may be adjusted to be identical with the potential of the data signal.

Alternatively, the first power signal terminal VDD may include a plurality of first sub-signal terminals which may output a plurality of power signals at different potentials, and a potential of a power signal outputted by each of the first sub-signal terminals is greater than a certain threshold. Similarly, the second power signal terminal VSS may also include a plurality of second sub-signal terminals which may output a plurality of power signals at different potentials, and a potential of a power signal outputted by each of the second sub-signal terminals is less than a certain threshold. After detecting the potential of the data signal provided from the data signal terminal DATA to the driving node C, if it is determined that the potential of the data signal is a high potential, the control sub-circuit may determine a target sub-signal terminal from the plurality of first sub-signal terminals, the potential of the power signal provided by which target sub-signal terminal is closest to the potential of the data signal, control the target sub-signal terminal to provide the first power signal to the holding sub-circuit in the pixel circuit, and control any of the second sub-signal terminals to provide the second power signal to the holding sub-circuit in the pixel circuit. Correspondingly, if it is determined that the potential of the data signal is a low potential, the control sub-circuit may determine a target sub-signal terminal from the plurality of second sub-signal terminals, the potential of the power signal provided by which target sub-signal terminal is closest to the potential of the data signal, control the target sub-signal terminal to provide the second power signal to the holding sub-circuit in the pixel circuit, and control any of the first sub-signal terminals to provide the first power signal to the holding sub-circuit in the pixel circuit.

Figure 11:
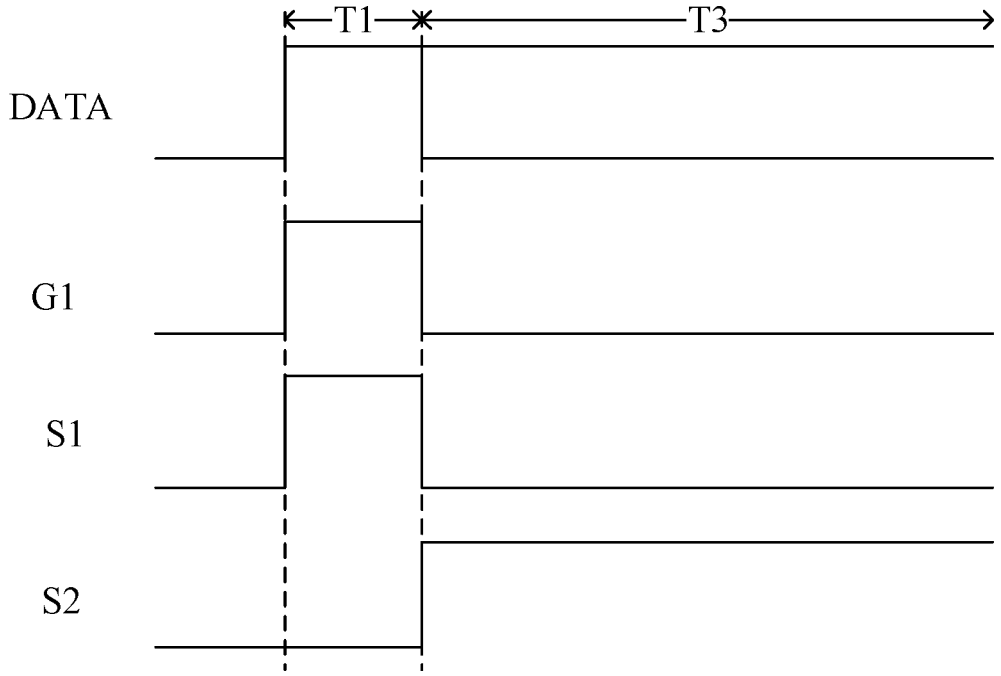
FIG. 11 is a timing diagram of a driving process of another pixel circuit provided by an embodiment of the present disclosure.

Further, as shown in FIG. 4, the switching circuit unit 201 further comprises a sixth transistor M6. A control terminal of the sixth transistor M6 is connected to the second switching signal terminal S2, a first terminal of the sixth transistor M6 is connected to the second storage node P2, and a second terminal of the sixth transistor M6 is connected to the driving node C. FIG. 11 is a timing diagram of a driving process for the pixel circuit shown in FIG. 4. Referring to FIG. 11, after the data writing phase T1, the driving method further comprises: in a reverse display phase T3, the driving signal provided by the driving signal terminal G1 and the first switching signal provided by the first switching signal terminal S1 being both at a second potential, and the second switching signal provided by the second switching signal terminal S2 being at a first potential. At that time, the seventh transistor M7 is turned off, the sixth transistor M6 is turned on, the potential of the second storage node P2 is written to the driving node C, and the light emitting sub-circuit 30 emits light under the driving of the potential of the driving node C.

Figure 12:
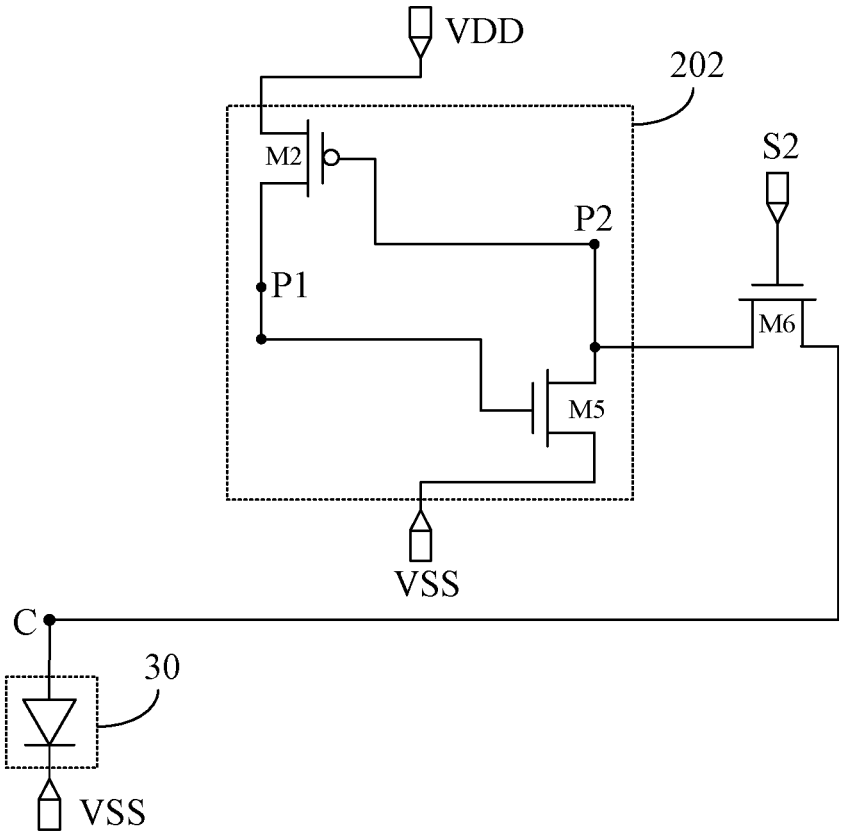
FIG. 12 is an equivalent circuit diagram of a pixel circuit provided by an embodiment of the present disclosure in a reverse display phase.

Specifically, FIG. 12 is an equivalent circuit diagram of the pixel circuit shown in FIG. 4 in the reverse display phase, in which the potential written to the first storage node P1 in the data writing phase T1 is a first potential. Referring to FIG. 12, the fifth transistor M5 remains turned on in the reverse display phase T3, and the second power signal terminal VSS continuously provides the second storage node P2 with the second power signal at the second potential to keep the second transistor M2 turned on, so that the first power signal terminal VDD can continuously provide the first storage node P1 with the first power signal at the first potential to ensure that the fifth transistor M5 is effectively turned on. The second storage node P2 is in communication with the driving node C through the sixth transistor M6 in the reverse display phase T3, so that the driving node C continues to maintain the second potential in case no data signal is inputted to the driving node C. The second potential is inverted from the first potential written in the data writing phase T1.

Figure 13:
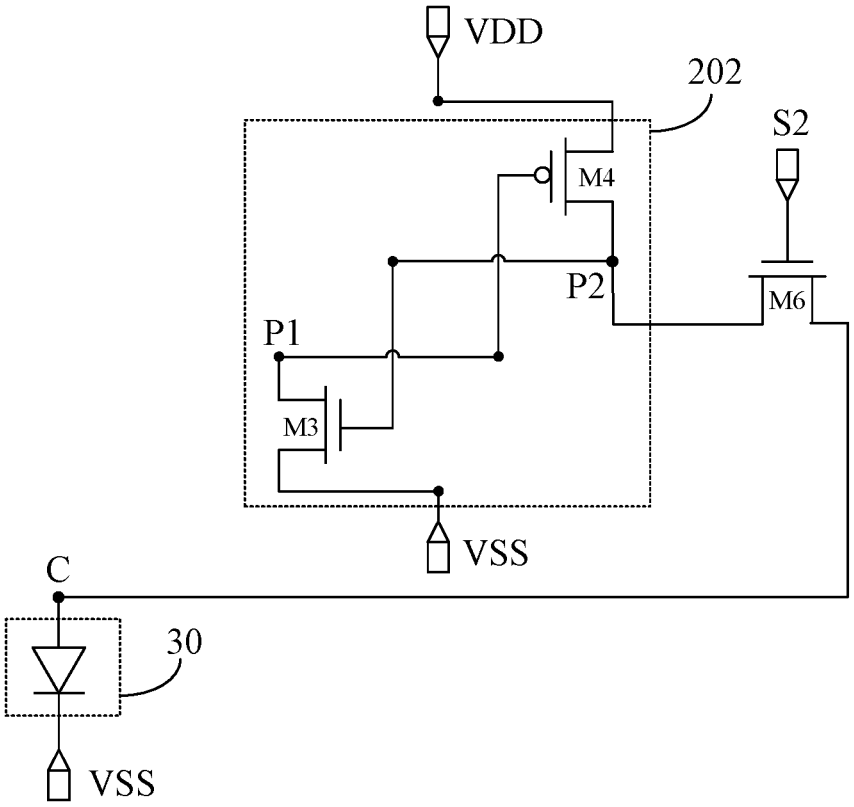
FIG. 13 is an equivalent circuit diagram of another pixel circuit provided by an embodiment of the present disclosure in a reverse display phase.

FIG. 13 is another equivalent circuit diagram of the pixel circuit shown in FIG. 4 in the reverse display phase, in which the potential written to the first storage node P1 in the data writing phase T1 is a second potential. Referring to FIG. 13, the fourth transistor M4 remains turned on in the reverse display phase T3, and the first power signal terminal VDD may continuously provide the second storage node P2 (i.e. the control terminal of the third transistor M3) with the power signal at the first potential to keep the third transistor M3 turned on, so that the second power signal terminal VSS can continuously provide the first storage node P1 with the second power signal at the second potential to make the fourth transistor M4 effectively turned on. In the reverse display phase T3, the second storage node P2 is in communication with the driving node C through the sixth transistor M6, so that the driving node C continues to maintain the first potential in case no data signal is inputted to the driving node C. The first potential is inverted from the second potential written in the data writing phase T1.

It can be obtained from the above analysis that, in the method for driving a pixel circuit as provided by an embodiment of the present disclosure, the potential of the driving node C in the reverse display phase can be inverted from the potential written in the data writing phase without the need for the data signal terminal DATA to provide a data signal, which in turn enables the display device to display an image opposite to the previous frame, for example, changing from an all-white image to an all-black image, or from an all-black image to an all-white image, thereby effectively reducing the power consumption of the display device.

It is to be noted that, in embodiments of the present disclosure, the pixel circuit may further comprise a detection sub-circuit which may detect timing of a data signal to be outputted by the data signal terminal DATA. If the detection sub-circuit detects that a potential of a data signal to be outputted is the same as that in the previous frame, it can be determined that the image displayed by the display device will remain unchanged, thus the pixel circuit can be controlled to perform the image holding phase after the data writing phase. If the detection sub-circuit detects that the timing of a data signal to be outputted is inverted from that in the previous frame, the pixel circuit can be controlled to perform the reverse display phase after the data writing phase.

It is to be noted that, in the embodiments described above, description is made based on an example in which the second transistor M2 and the fourth transistor M4 are P-type transistors, the remaining transistors are N-type transistors, and the first potential is a higher potential relative to the second potential. Certainly, the second transistor M2 and the fourth transistor M4 may also employ N-type transistors, and the remaining transistors may be P-type transistors. In this case, the first potential may be a lower potential relative to the second potential, and a potential change at each of the signal terminals may be opposite to that as shown in FIG. 6 or 11 (i.e. the phase difference therebetween is 180 degrees).

Those skilled in the art can clearly appreciate that, for the convenience and brevity of description, specific operating processes of the pixel circuit and each sub-circuit described above may refer to corresponding processes in embodiments of the method described above, and details are not described herein again.

An embodiment of the present disclosure further provides a display device comprising any of the pixel circuits described above. The display device may be any product or component having a display function such as a liquid crystal panel, an electronic paper, an OLED panel, an AMOLED panel, a mobile phone, a tablet computer, a television, a display, a notebook computer, a digital photo frame, a navigator, and the like.

What have been described above are only exemplary embodiments of the present disclosure, and are not intended to limit the present disclosure. Any modifications, equivalent substitutions, improvements, etc. made within the spirit and principle of the present disclosure should be encompassed in the protection scope of the present disclosure.

The invention claimed is:

1. A method for driving a pixel circuit, wherein the pixel circuit comprises:

a driving sub-circuit;

a holding sub-circuit; and a light emitting sub-circuit, wherein the driving sub-circuit is connected to a driving signal terminal, a data signal terminal and a driving node, and configured to provide the driving node with a data signal from the data signal terminal under control of a driving signal from the driving signal terminal, wherein the holding sub-circuit is connected to the driving node, a first switching signal terminal, a first power signal terminal and a second power signal terminal, and configured to acquire a potential of the driving node under control of a first switching signal from the first switching signal terminal, and maintain the potential of the driving node unchanged under control of a first power signal from the first power signal terminal and a second power signal from the second power signal terminal, and wherein the light emitting sub-circuit is connected to the driving node and configured to emit light under driving of the driving node, the method comprising:

in a data writing phase, performing operations comprising:

configuring the driving signal and the first switching signal to a first potential, providing, by the driving sub-circuit, the data signal to the driving node;

acquiring, by the holding sub-circuit, a potential of the driving node; and in an image holding phase, performing operations comprising:

configuring the driving signal to a second potential, maintaining the first switching signal at the first potential, while the data signal terminal is not providing a data signal, configuring the first power signal at the first potential, configuring the second power signal at the a second potential, and maintaining, by the holding sub-circuit, the potential of the driving node unchanged.

2. The method according to claim 1, wherein the holding sub-circuit comprises a switching circuit unit and a holding circuit unit, wherein the switching circuit unit comprises a first transistor, wherein the holding circuit unit comprises a second transistor, a third transistor, a fourth transistor and a fifth transistor, and the driving sub-circuit comprises a seventh transistor, wherein in the data writing phase, the driving signal and the first switching signal being both at the first potential, the first transistor and the seventh transistor being turned on, the data signal terminal providing the data signal to the driving node, the driving node being in communication with a first storage node, and the potential of the driving node being written to the first storage node, wherein in the image holding phase, performing operations comprising:

configuring the driving signal to the second potential;

maintaining the first switching signal at the first potential;

turning off the seventh transistor; and turning on the first transistor, in response to a potential written to the first storage node being the first potential in the data writing phase, the fifth transistor being turned on, the second power signal terminal writing the second power signal to a second storage node, the second transistor being turned on, and the first power signal terminal writing the first power signal to the first storage node; and in response to the potential written to the first storage node being the second potential in the data writing phase, turning on the fourth transistor, the first power signal terminal writing the first power signal to the second storage node, turning on the third transistor, and the second power signal terminal writing the second power signal to the first storage node.

3. The method according to claim 2, wherein the switching circuit unit further comprises a sixth transistor, wherein a control terminal of the sixth transistor is connected to a second switching signal terminal, a first terminal of the sixth transistor is connected to the second storage node, and a second terminal of the sixth transistor is connected to the driving node, after the data writing phase, the method further comprises:

in a reverse display phase, configuring the driving signal and the first switching signal being to the second potential, configuring a second switching signal outputted by the second switching signal terminal to the first potential, turning off the seventh transistor, turning on the sixth transistor, writing the potential of the second storage node to the driving node, and driving the light emitting sub-circuit emitting light by the driving node.

4. The method according to claim 2, wherein the first transistor, the third transistor, the fifth transistor and the seventh transistor are N-type transistors, and the second transistor and the fourth transistor are P-type transistors; and wherein the first potential is at a higher potential relative to the second potential.

* * * * *